US006174110B1

(12) United States Patent
Papadopoulos

(10) Patent No.: US 6,174,110 B1
(45) Date of Patent: Jan. 16, 2001

(54) SHORING LEG

(75) Inventor: Demetrios Georgiou Papadopoulos, Middlesex (GB)

(73) Assignee: SGB Services Plc., London (GB)

( * ) Notice: Under 35 U.S.C. 154(b), the term of this patent shall be extended for 0 days.

(21) Appl. No.: 09/205,036

(22) Filed: Dec. 4, 1998

(30) Foreign Application Priority Data

Dec. 4, 1997 (GB) ..... 9725720

(51) Int. Cl.[7] ..... F16B 21/06; F16B 1/027; F16B 1/10

(52) U.S. Cl. ..... 405/290; 405/272; 248/354.4; 285/318; 285/921; 403/330

(58) Field of Search ..... 405/272, 282, 405/284, 290, 288; 248/354.4, 354.6; 285/318, 921; 403/327, 330

(56) References Cited

U.S. PATENT DOCUMENTS 3,957,304 * 5/1976 Kutsky et al. ..... 297/468
5,318,388 * 6/1994 Papadopoulos ..... 405/290
5,971,334 * 10/1999 Crawshaw et al. ..... 248/230.6

FOREIGN PATENT DOCUMENTS

332026 * 7/1930 (GB) .
639129 * 6/1950 (GB) .
2265921 10/1993 (GB) .

* cited by examiner

*Primary Examiner*—David Bagnell
*Assistant Examiner*—Tara L. Mayo
(74) *Attorney, Agent, or Firm*—Sidley & Austin

(57) ABSTRACT

A shoring leg is provided with a latch for use in maintaining an end plate of the shoring leg and a jack collar in a predetermined position relative to each another.

The latch comprises a latch member having a slot to receive a mounting bracket which mounts the latch member for pivotal movement relative to the mounting means from a latching position to a release position. The latch member defines a recess adapted, when in the latching position, to receive part of the leg end plate and a corresponding part of an adjacent collar of the jack to retain the end plate and collar in the predetermined position. The latch member is biased into the latching position by a coil spring acting between the leg and the latching member.

14 Claims, 3 Drawing Sheets

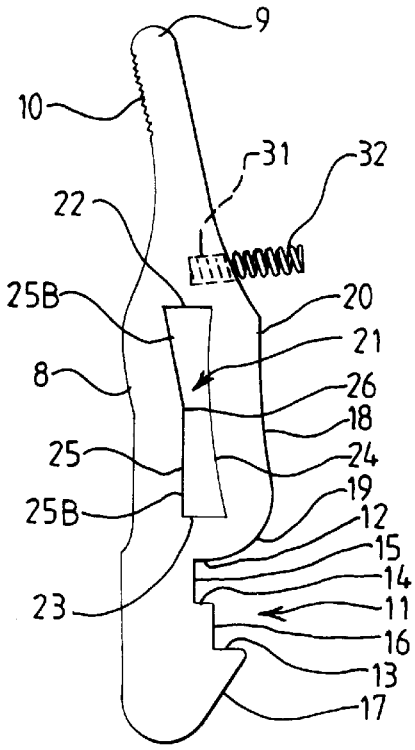
FIG 3
FIG 4
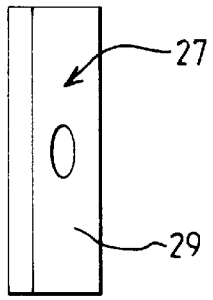
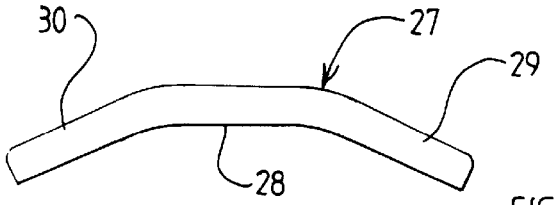
FIG 5

SHORING LEG

FIELD OF THE INVENTION

This invention relates to a shoring leg and, more particularly, to a shoring.

BACKGROUND OF THE INVENTION

A known shoring system comprises a plurality of vertical legs each of.

A known shoring system comprises a plurality of vertical legs each of which is provided with an adjustable jack at the bottom thereof. A screw-threaded portion of the jack is inserted into the leg and the jack carries a rotatable threaded collar which abuts an end plate carried by the leg. As the collar is rotated, it moves up or down the threaded portion of the jack, thereby lifting or lowering the leg. In this known system, when moving the vertical legs, a jack can become disconnected from its leg, thereby necessitating additional work in relocating the jack within the leg.

In order to obviate or reduce this problem, it has previously been proposed in UK Patent GB2265921 to provide a shoring leg with a latch which serves to maintain an end plate of the shoring leg and a collar of the jack in a predetermined position relative to one another. The known latch comprises a latch member mounted on the leg for movement between a latching position and a release position, the latch member defining adjacent one end thereof a recess adapted, when in the latching position, to receive part of the leg end plate and adjacent one end thereof the adjacent collar of the jack to retain the end plate and the collar in the predetermined position. The latch member is retained in the latching position by means of a leaf spring which is attached to the shoring leg and to which the latch member is secured. The latch member is provided with an integrally formed fulcrum in the form of a stub which contacts the leg, whereby the latch member is movable from its latching position into its release position by pressing on the other end of the latch member to pivot the latch member about the stub.

Whilst the known shoring leg and its latch operate satisfactorily, the present invention aims to provide a shoring leg having a latch requiring fewer components.

SUMMARY OF THE INVENTION

Accordingly, the present invention provides a shoring leg provided with a latch for use in maintaining an end plate on the shoring leg and a jack collar in a predetermined position relative to each other, the latch comprising a latch member mounted on the leg to execute a movement from a latching position to a release position, the latch member defining a recess adapted, when in the latching position, to receive part of the leg end plate and to receive a corresponding part of an adjacent collar of a jack to retain the end plate and the collar in said predetermined position, there being means to retain the latch member in the latching position, in which shoring leg the latch member is attached to the leg by mounting means which mounts the latch member for movement relative to the mounting means between the latching position and the release position.

The latch member may be pivotally mounted on the mounting means. The mounting means is typically a mounting bracket fixedly attached to the leg, and the latch member is pivotally mounted on a fulcrum plate of the mounting bracket.

The fulcrum plate of the mounting bracket may be received in a mounting slot formed in the latch member and preferably a central region of the mounting slot of the latch member is narrower than the end regions of the slot. Thus, typically, an inner longitudinal edge of the slot is of arcuate form and an outer longitudinal edge of the slot comprises two linear portions which are inclined to one another so as to meet a fulcrum comer about which the latch is pivotable on the fulcrum plate of the mounting bracket.

The recess may comprise an indentation receiving the leg end plate and a rebate for receiving the jack collar.

The latch member is preferably an elongate member, the recess being defined adjacent one end of the elongate member. The elongate member may be provided at the end thereof remote from the recess, with a finger tab.

Where the latch is an elongate member, the end of the elongate member which is provided with the recess may also be provided with an inclined cam face adjacent the recess.

Conveniently the latch member is at least partially received in a channel which extends axially of the leg. Resilient means, such as a spring, typically in the form of a coil spring which is compressed between the latch member and the leg, is used to retain the latch member in the latching position.

The invention also relates to a leg as described above in combination with a jack, the jack having a collar adjacent the end plate of the leg, part of the end plate of the leg and the corresponding part of the collar being received in the said recess formed in the latch member.

BRIEF DESCRIPTION OF THE DRAWINGS

In order that the invention may be more readily understood, an embodiment thereof will now be described, by way of example, with reference to the accompanying drawings, in which:

FIG. 3 is side view of a latch member of the latch, showing a mounting slot of the latch member;

FIG. 4 is a side view of a mounting plate of the shoring leg latch; and

FIG. 5 is an end view of the mounting plate.

DETAILED DESCRIPTION OF THE INVENTION

Figure 1:
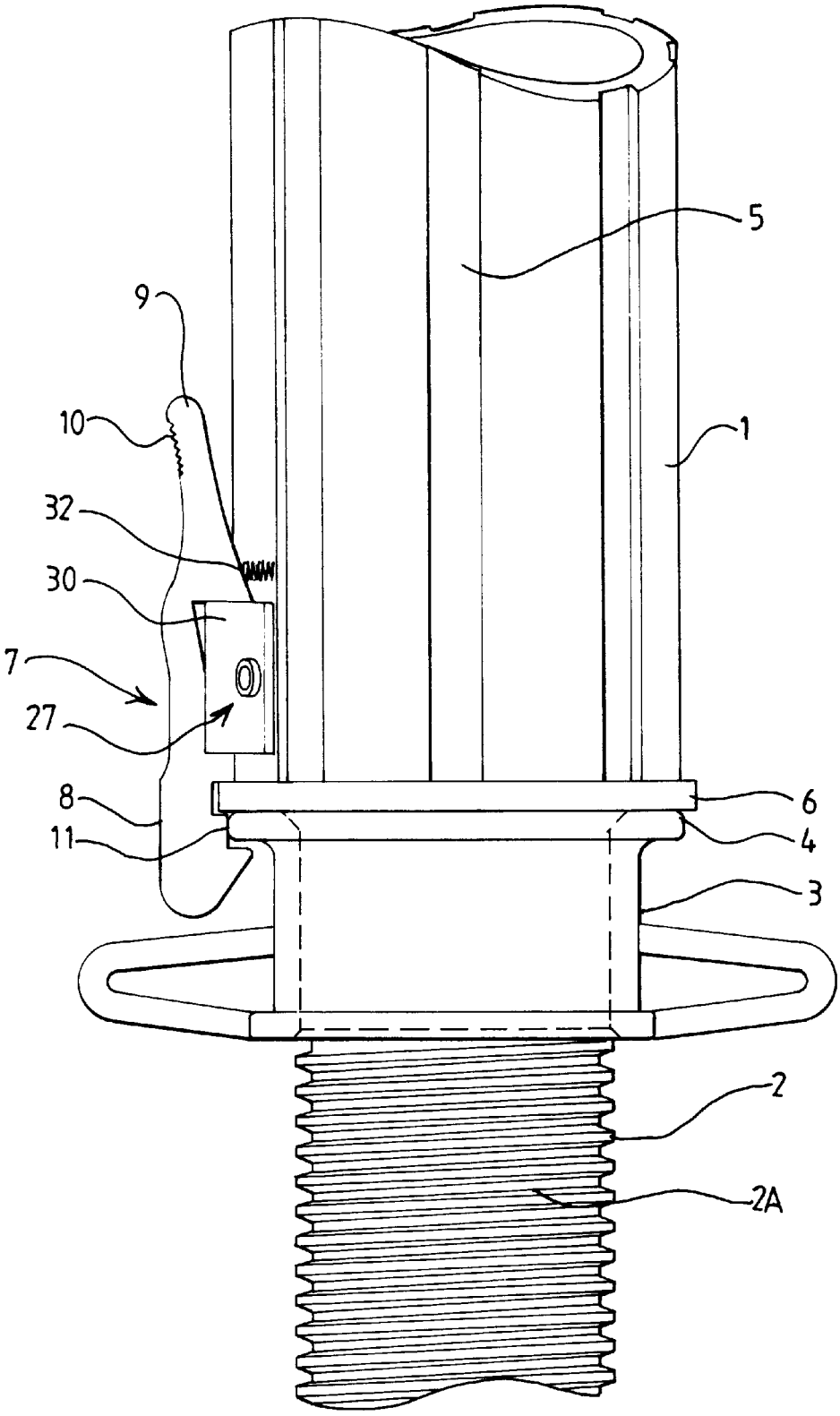
FIG. 1 is a side view of a shoring leg having a latch engaged with a jack collar, the leg and the jack being shown partly in phantom.
Figure 2:
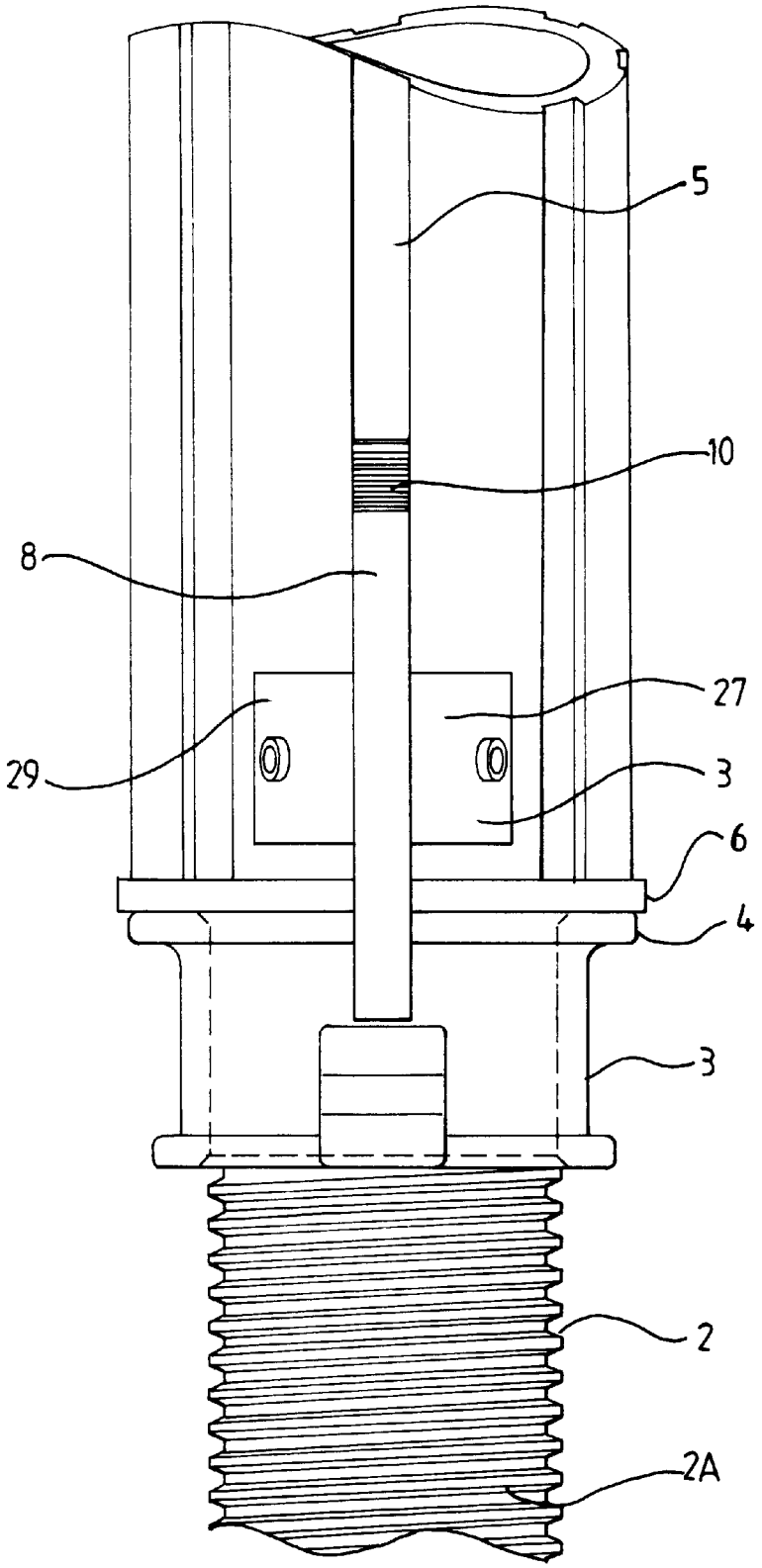
FIG. 2 is a front view of the shoring leg of FIG. 1.

Referring now to the drawings, a hollow vertical shoring leg 1 is provided at its lower end with an adjustable jack 2. The jack has a portion (not shown) for engaging the ground to support a vertical screw-threaded portion 2A on which is rotatably mounted an internally threaded collar 3. The screw-threaded portion of the jack 2 is dimensioned to be received within the hollow leg 1. The collar 3 has an upper radially outwardly projecting lip 4 dimensioned to engage the lower end of the leg 1 and thus support the leg.

The leg 1 consists of an extruded tube of aluminium with a substantially circular cross-section. The outer surface of the leg 1 is provided with axially extending channels 5. The leg 1 carries an annular end plate 6 which is fixed at the bottom of the leg 1 for engagement with the jack collar 3. The end plate 6 projects radially outwardly of the leg 1 and has a greater external diameter than that of the jack collar 3. When shoring incorporating the leg 1 is to be moved, the leg 1 may be lifted. In order to prevent the jack 2 from becoming separated from the leg 1 when the leg is lifted, the leg is provided with a latch 7 which acts to retain the jack 2 in position.

The latch 7 comprises a vertically disposed elongate member 8 which is partially received in one of the axially extending channels 5 of the leg 1. An upper portion of the exposed outer face of the latch member 8 is formed at its upper end 9 with a kiurled finger tab 10. A lower portion of the inner face of the latch member 8 defines a recess 11. The inwardly facing recess 11 is bounded by upper and lower walls 12 and 13 which are substantially perpendicular to the longitudinal axis of the latch member 8. A partition wall 14 parallel to the walls 12 and 13 defines a step in the recess 11 which divides the recess into an upper indentation 15 and a lower rebate 16, the indentation 15 extending deeper into the latch member 8 than the rebate 16. A sloping cam surface 17 extends downwardly and outwardly from the inner edge of the lower boundary wall 13, while the upper boundary wall 12 is connected to the lower end of a concave central portion 18 of the inner face of the latch member 8 by a rounded shoulder 19. An upper end of the central portion 18 meets an upper portion of the inner face of the latch member 8 at a cusp 20.

The latch member 8 is formed with a mounting slot 21 which extends longitudinally of the leg 1 in a central portion thereof. The slot 21 comprises upper and lower end edges 22 and 23 which are substantially perpendicular to the longitudinal axis of the latch member 8. Inner and outer longitudinal edges 24 and 25 of the slot 21 extend between the end edges 22 and 23. The inner longitudinal edge 24 is an outwardly convex arcuate edge. The outer longitudinal edge 25 comprises upper and lower linear portions 25A and 25B of equal length which are inclined relative to one another so as to meet at a fulcrum corner 26, thereby defining with the inner longitudinal edge 24 of the slot 21 a central waist in the slot from which the width of the slot increases towards each end of the slot 21.

The latch 7 is located at the bottom end of the leg 1, so that the indentation 15 of the recess 11 is aligned with the end plate 6 of the leg 1 and can accommodate a peripheral part of the end plate, while a corresponding part of the collar lip 4 can be received in the rebate 15 of the recess 11 when the lip is adjacent to the end plate 6.

A rigid mounting bracket 27 for mounting the latch member 8 on the leg 1 is shown in FIGS. 4 and 5. The mounting bracket 27 is formed from a horizontally elongate rectangular strip bent to form a central fulcrum plate 28 flanked by mounting wings 29 and 30 which extend at an angle to the fulcrum plate 28 from respective vertical edges of the fulcrum plate 28. The width of the strip from which the mounting bracket 27 is made is slightly less than the length of the mounting slot 21 of the latch member 8, while the thickness of the strip is substantially equal to the horizontal distance between the fulcrum corner 26 of the outer longitudinal edge 25 of the mounting slot 19 and the opposing point on the arcuate inner edge 24 of the slot 21. The mounting bracket 27 extends through the mounting slot 21 in the latch member 8, so that the latch member is supported on the fulcrum plate 28 of the mounting bracket 27. Each of the mounting wings 29 and 30 of the mounting plate 27 is fixedly attached to the leg 1 by suitable fasteners, such as rivets, so that the fulcrum plate overlies the channel 5 of the leg 1 in which the latch member 8 is partially received.

A blind bore 31 is formed in the latch member 8 above the mounting slot 21, the bore 31 extending into the member 8 transversely of the longitudinal axis of the member 8 from an upper portion of the inner face of the member 8. A biasing coil spring is partially received in the bore 31 so that it is retained in a compressed condition between the member 8 and the bottom of the channel 5 in which the member 8 is received.

In a normal latching position of the latch 7 shown in FIG. 1 the latch member 8 is biased by the action of the spring 32 so that the latch member 8 sits on the fulcrum plate 28 of the mounting bracket 27 with the lower linear portion 25B of the outer edge 25 of the slot 21 in engagement with the outer surface of the fulcrum plate 28. In this position, a peripheral portion of the end plate 6 is received in the indentation 15 with the upper wall 12 of the latch recess 11 is in direct contact with the upper surface of the end plate 6 and the collar lip 4 which abuts end plate 6 is accommodated within the rebate 16 of the latch recess 11. If, for any reason, such as the leg being moved, the collar 3 starts to separate from the leg 1, the lower wall 13 of the latch recess engages the collar lip 4 and holds the jack 2 and the leg 1 together, preventing separation of the jack 2 from the leg 1.

To release the latch 7, the finger tab 10 on the latch member 8 is depressed towards the leg 1 against the action of the spring 32. This causes the latch member 8 to pivot on the fulcrum plate 28 about the fulcrum comer 26, so that the lower linear portion 25B of the outer longitudinal edge 25 of the slot 21 moves away from the fulcrum plate. The pivoting movement of the latch member continues until the upper linear portion 25A of the outer longitudinal edge 25 of the slot 21 comes into contact with the fulcrum plate. In this fully depressed position, the latch 7 is in a release position in which the collar 3 can be removed from the rebate 16, thereby allowing the portion of the jack 2 within the leg 1 to be withdrawn.

If the leg 1 is lowered onto the jack 2 with the latch in its normal latching position, the cam surface 17 first comes into contact with the collar lip 4. The cam surface slides over the collar lip 4, causing the lower part of the catch member to move radially outwardly until the collar lip 4 passes beyond the lower wall 13 of the recess and is captured within the recess 11 as the latch 7 is returned to its normal latching position by the spring 32.

Alternatively, the leg 1 may be lowered onto the jack 2 with the finger tab 10 fully depressed. In this case, the cam surface 17 does not come into contact with the collar lip 4 and the operating lever is not released until the collar lip 4 comes into contact with the end plate 6. When this occurs, the finger tab 10 is released and the latch 7 returns to its normal latching position.

What is claimed is:

1. A shoring leg provided with a latch for use in maintaining an end plate on the shoring leg and a jack collar in a predetermined position relative to each other, the latch comprising a latch member mounted on the leg to execute a movement from a latching position to a release position, the latch member defining a recess adapted, when in the latching position, to receive part of the leg end plate and to receive a corresponding part of the lack collar, the corresponding part of the lack collar being adjacent to the leg end plate, to retain the end plate and the collar in said predetermined position, there being means to retain the latch member in the latching position, in which shoring leg the latch member is attached to the leg by mounting means which mounts the latch member for movement relative to the mounting means between the latching position and the release position, the latch member being pivotably mounted on the mounting means, the mounting means comprising a mounting bracket fixedly attached to the leg and having a fulcrum plate, the latch member being pivotably mounted on the fulcrum plate of the mounting bracket.

2. A leg according to claim 1, wherein the fulcrum plate of the mounting bracket is received in a mounting slot formed in the latch member.

3. A leg according to claim 2, wherein a central region of the mounting slot of the latch member is narrower than end regions of the slot.

4. A leg according to claim 3, wherein an inner longitudinal edge of the slot is of arcuate form and an outer longitudinal edge of the slot comprises two linear portions which are inclined to one another so as to meet at a fulcrum comer about which the latch is pivotable on the fulcrum plate of the mounting bracket.

5. A leg according to claim 1, wherein the recess comprises an indentation for receiving the leg end plate and a rebate for receiving the jack collar.

6. A leg according to claim 1, wherein the latch member is an elongate member, the recess being defined adjacent one end of the elongate member.

7. A leg according to claim 6, wherein the end of the elongate member is provided with a finger tab.

8. A leg according to claim 6, wherein the one end of the elongate member is provided with an inclined cam face adjacent the recess.

9. A leg according to claim 6, wherein the elongate member is at least partially received in a channel which extends axially of the leg.

10. A leg according to claim 1, wherein the means to retain the latch member in the latching position is resilient means.

11. A leg according to claim 10, wherein the means to retain the latch member in the latching position is a spring.

12. A leg according claim 11, wherein the means to retain the latch member in the latching position is a coil spring.

13. A leg according to claim 12, wherein the coil spring is a compression spring compressed between the latch member and the leg.

14. A leg according to claim 4 in combination with a jack, the jack having a collar adjacent the end plate of the leg, part of the end plate of the leg and a corresponding part of the collar being received in said recess.

* * * * *

UNITED STATES PATENT AND TRADEMARK OFFICE

CERTIFICATE OF CORRECTION

PATENT NO. : 6,174,110 B1
DATED : January 16, 2001
INVENTOR(S) : Demetrios Georgiou Papadopoulos It is certified that error appears in the above-identified patent and that said Letters Patent is hereby corrected as shown below:

Title page,
Item [30] Foreign Application Priority Data, delete "9725720", and insert -- 9725720.8 --.

Column 4,
Line 52 (claim 1, line 8), delete "lack", and insert -- jack --.
Line 53 (claim 1, line 9), delete "lack", and insert -- jack --.

Column 6,
Line 15 (claim 14, line 1), delete "claim 4", and insert -- claim 1 --.

Signed and Sealed this

Second Day of October, 2001

*Attest:*

Nicholas P. Godici

NICHOLAS P. GODICI
*Acting Director of the United States Patent and Trademark Office*

*Attesting Officer*